US008958593B2

(12) United States Patent
Tao et al.

(10) Patent No.: US 8,958,593 B2
(45) Date of Patent: Feb. 17, 2015

(54) MULTIPLE-ORIENTATION, FREE-STANDING, PORTABLE SPEAKER

(75) Inventors: Di Tao, Mississauga (CA); Brian Dennis Paschke, Mississauga (CA); Aaron Michael Szymanski, Mississauga (CA)

(73) Assignee: BlackBerry Limited, Waterloo, Ontario (CA)

( * ) Notice: Subject to any disclaimer, the term of this patent is extended or adjusted under 35 U.S.C. 154(b) by 8 days.

(21) Appl. No.: 13/617,020

(22) Filed: Sep. 14, 2012

(65) Prior Publication Data

US 2014/0079276 A1 Mar. 20, 2014

(51) Int. Cl.
*H04R 1/02* (2006.01)
*H04R 9/06* (2006.01)

(52) U.S. Cl.
CPC ..... *H04R 1/02* (2013.01)
USPC ..... 381/386; 381/87; 381/334; 381/336; 381/387; 381/394

(58) Field of Classification Search
CPC ..... H04R 5/00; H04R 5/02; H04R 5/027; H04R 5/04; H04R 2205/024; H04R 2420/05; H04R 2420/09
USPC ..... 381/87, 111, 116, 117, 124, 150, 332, 381/334, 336, 337, 345, 386, 387, 394; 181/144, 148, 153
See application file for complete search history.

(56) References Cited

U.S. PATENT DOCUMENTS

2005/0084126 A1* 4/2005 Milton ..... 381/336
2007/0110265 A1* 5/2007 Kirkeby et al. ..... 381/300
2012/0183167 A1* 7/2012 Pelonis ..... 381/332

FOREIGN PATENT DOCUMENTS

WO 02082856 A2 10/2002

OTHER PUBLICATIONS

European Search Report for European Application No. EP 12184573.9 dated Feb. 4, 2013; 7 pages.

* cited by examiner

*Primary Examiner* — Matthew Eason
(74) *Attorney, Agent, or Firm* — Conley Rose, P.C.; J. Robert Brown, Jr.

(57) ABSTRACT

A speaker comprises a housing that defines an internal cavity and includes a front panel, a first side, a second side, and a third side. The speaker also includes a controller, an actuator, and a sound generating member that are disposed within the internal cavity. The controller is in communication with the actuator, and the actuator is configured for causing the sound generating member to vibrate, and thereby generate sound waves, as instructed by the controller. The front panel is configured to transmit the sound waves. The speaker has a center of mass that is affected by a position of the controller and the actuator, and the controller and the actuator are arranged and positioned so that the center of mass of the speaker is positioned along an axis that extends from, and is perpendicular to, the first side.

3 Claims, 5 Drawing Sheets

MULTIPLE-ORIENTATION, FREE-STANDING, PORTABLE SPEAKER

BACKGROUND

In today's world, portable speakers are becoming increasingly popular for enhancing the listening experience associated with other portable electronic devices such as cell phones and smart phones. Unfortunately, speakers intended for use with such portable electronic devices often support only a single orientation, and this single orientation may not suit the particular needs or desires of a user as those needs change from location to location or from use to use. For example, in one location or use, it may desirable to position the speaker so that the sounds it produces are aimed in a first direction, while, in another location or use, it may desirable to position the speaker so that the sounds it produces are aimed in a second, different direction.

In addition to having control over the directions in which sounds produced by the speaker are aimed, it may also be desirable to have control over other aspects of the sounds that are produced. For example, in one speaker orientation, such as an orientation wherein sounds are projected in a substantially horizontal direction, it may be desirable to project the sounds within a narrower angle, while, in another orientation, such as an orientation wherein sounds are projected in a substantially vertical direction, it may be desirable to project the sounds within a wider angle.

Accordingly, it is desirable to have a free-standing, portable speaker that provides multiple orientations from which the sounds may be projected. It is also desirable to have a freestanding portable speaker that can automatically accommodate different listening modes based on the selected orientation.

BRIEF DESCRIPTION OF THE DRAWINGS

For a more complete understanding of this disclosure, reference is now made to the following brief description, taken in connection with the accompanying drawings and detailed description, wherein like reference numerals represent like parts.

DETAILED DESCRIPTION

It should be understood at the outset that although illustrative implementations of one or more embodiments of the present disclosure are provided below, the disclosed systems and/or methods may be implemented using any number of techniques, whether currently known or in existence. The disclosure should in no way be limited to the illustrative implementations, drawings, and techniques illustrated below, including the exemplary designs and implementations illustrated and described herein, but may be modified within the scope of the appended claims along with their full scope of equivalents.

Figure 1:
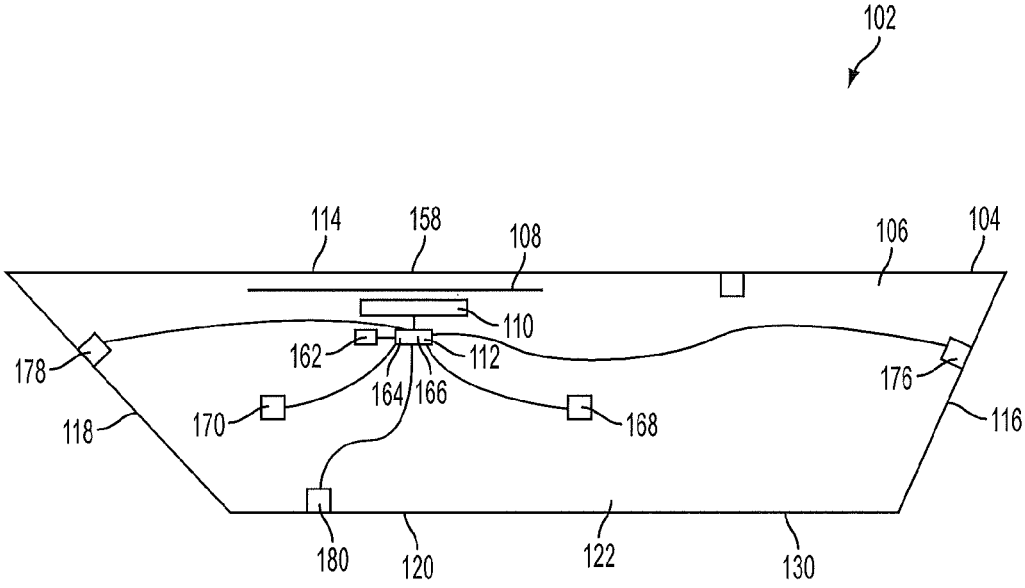
FIG. 1 is schematic drawing showing a side view of an exemplary speaker with internal components shown and with the speaker disposed on a side for emitting sound in an upward direction.

As shown in FIG. 1, a portable speaker 102 comprises a housing 104 that defines an internal cavity 106, within which a sound generating member (i.e., a vibrating member) 108 is disposed. The housing 104 may comprise metal, plastic or composite materials and may be formed via a molding process or via suitable machining processes such as CNC machining. An actuator 110 is positioned for cooperation with (e.g., adjacent to) the sound generating member 108 and is configured for causing the sound generating member 108 to vibrate, and to thereby generate sound waves, as instructed by a controller 112.

It should be appreciated that the terms configured for and configured to refer to a condition wherein the element or feature that is so configured is capable of performing the designated function even if the element or feature does not necessarily perform the designated function at all times. For example, it should be appreciated from the foregoing description of the actuator 110, that the actuator 110 is capable of causing the sound generating member 108 to vibrate, and to thereby generate sound waves, as instructed by a controller 112. Moreover, it should be appreciated that the actuator 110 is capable of causing the sound generating member 108 to vibrate, and to thereby generate sound waves, as instructed by a controller 112 even if the actuator 110 does not necessarily do so at all times. Thus, the actuator 110, the sound generating member 108, and the controller 112 are coupled (i.e., electrically, mechanically, magnetically, pneumatically, hydraulically) to one another, and configured for (i.e., capable of) cooperation with one another, such that the sound generating member 108 produces sound waves substantially as instructed by the controller 112.

Figure 2:
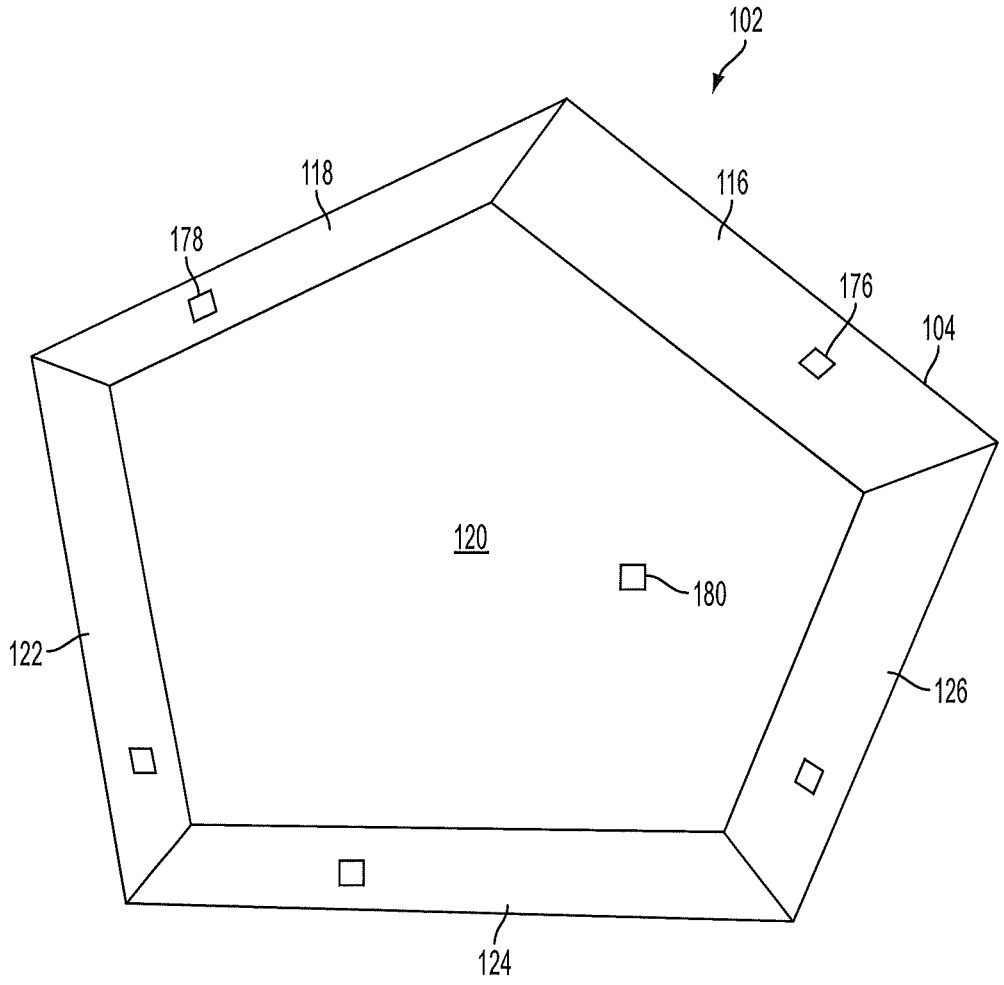
FIG. 2 is drawing of an exemplary multiple-sided speaker viewed from a rearward direction.

In an exemplary embodiment, the housing 104 is substantially rigid and impervious to infiltration of foreign matter so as to provide a protected environment for a plurality of components (e.g., the actuator 110, the sound generating member 108, the controller 112, and the power storage device 170) disposed within the internal cavity 106. The housing 104 includes a front panel 114, a first side 116, a second side 118, and a third side 120. It should be appreciated that, as shown in FIG. 2, the housing 104 may include a fourth side 122, a fifth side 124, and a sixth side 126, as well as additional sides. It should also be appreciated that the names selected for the sides (i.e., the first side 116, the second side 118, etc.) are chosen for convenience and do not necessarily indicate the order of the sides. Put another way, it should be appreciated that the second side 118 is not necessarily adjacent to the first side 116 or the third side 120, although that may be the case, particularly when the housing 104 includes only three sides. It should also be appreciated that a side 116, 118, 120 need not be positioned adjacent to the front panel 114 of the housing 104.

In an exemplary embodiment, the first side 116, second side 118, and third side 120 each define a respective planar surface that may serve as a base 130 upon which the speaker 102 is supported in a desired orientation. As will be appreciated by one of ordinary skill in the art, the portable speaker 102 has a center of mass 128 (FIG. 3) that is affected by a position of the components (e.g., the controller 112, the actuator 110, a power storage device 170, or any other components) that are disposed within the housing 104 (FIG. 1). Accordingly, the positions of the components may be arranged and positioned within the housing 104 to facilitate use of the first side 116, second side 118, and third side 120 as a base 130 upon which the speaker 102 is supported in a desired orientation.

Figure 3:
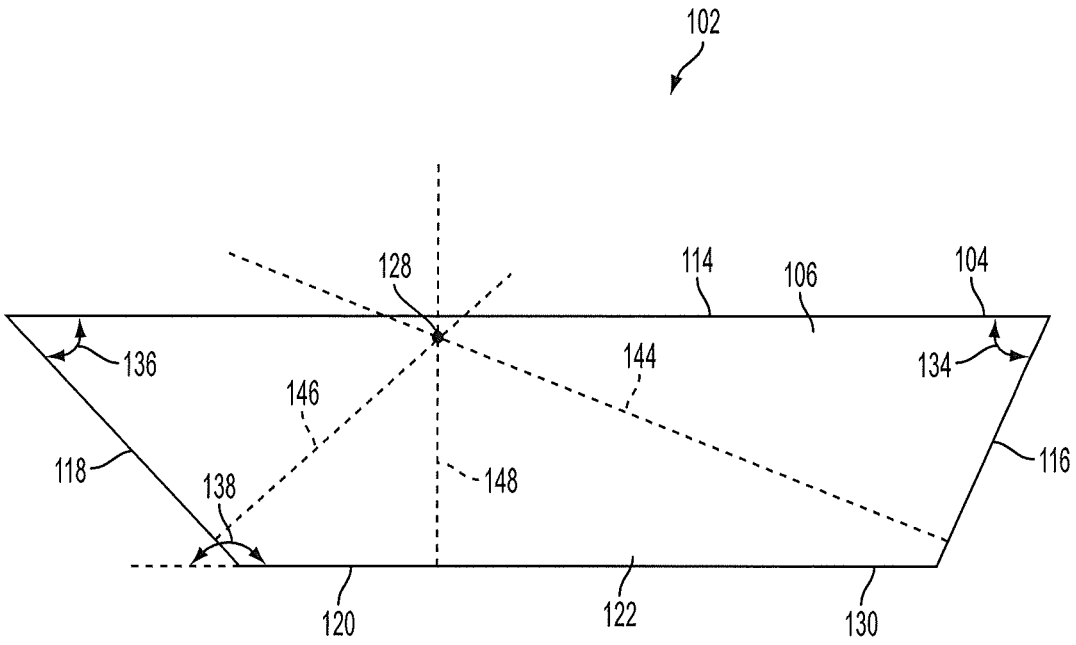
FIG. 3 is drawing showing a side view of the speaker of FIG. 1 showing position of the center of mass in relation to sides of the speaker.
Figure 4:
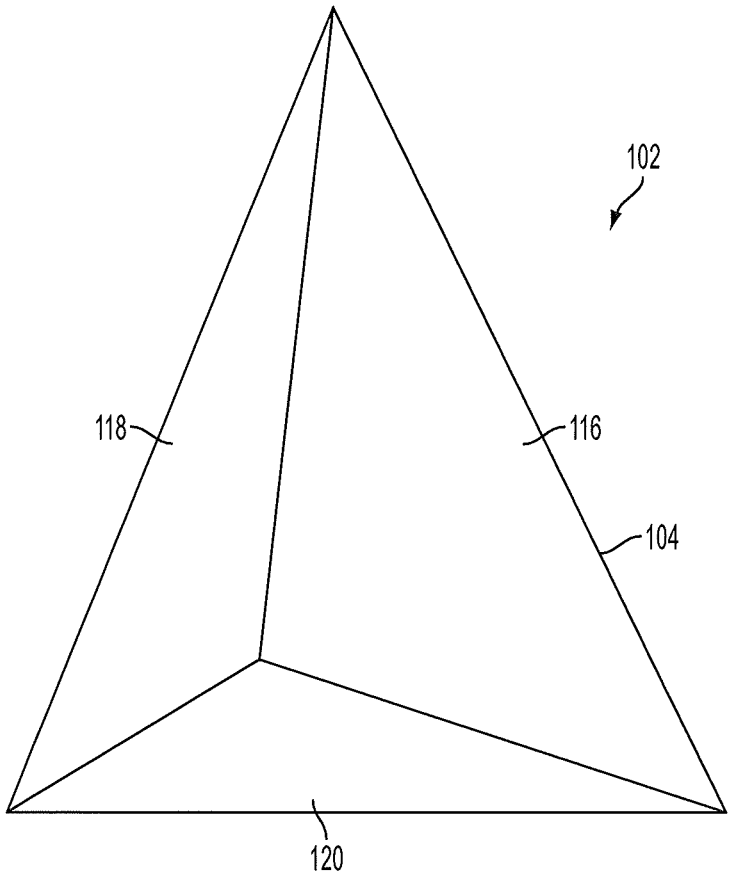
FIG. 4 is drawing of an exemplary multiple-sided speaker viewed from a rearward direction.

With particular reference to FIG. 3, in order to provide for stability in such use, without requiring a kickstand or other support-providing member(s) (i.e., to lend a free-standing quality to the portable speaker 102), the components may be arranged and positioned within the housing 104 so that the center of mass 128 of the speaker 102 is positioned along an axis that extends from, and is perpendicular to, a side such that the side may serve as a base for the speaker 102. Put another way, the side is positioned and oriented relative to the center of mass 128 such that an axis extending perpendicular to the side passes through the center of mass 128. For example, as shown in FIG. 1, the center of mass 128 of speaker 102 is positioned along a first axis 144 that extends from, and is perpendicular to, the first side 116. Accordingly, when the speaker 102 is supported on the first side 116, the center of mass 128 is positioned above the first side 116.

To provide a number of free-standing speaker orientations from which the sounds may be projected in a corresponding number of selectable directions, the first side 116 of the housing 104 is disposed at a first angle 134 relative to the front panel 114, while the second side 118 is disposed at a second angle 136 relative to the front panel 114, with the second angle 136 differing from (e.g., being less than) the first angle 134. As shown in FIG. 3, the third side 120 is substantially parallel to the front panel 114 (i.e., the angle between the third side 120 and the front panel 114 is approximately 0). Accordingly, when the third side 120 is used as a base, the front panel may be aimed in a substantially vertical direction such that sound waves emanate vertically from the speaker 102. Such an orientation may be useful as a conference mode for use in teleconferencing. As used herein the term vertical refers to a direction that substantially opposes the direction in which the gravity force is directed, and the term horizontal refers to a direction that is substantially perpendicular to the direction in which the gravity force is directed.

As shown in FIG. 3, to facilitate use of the first side 116 as a base without requiring a kickstand or other support-providing member(s), the controller 112 and the actuator 110 are arranged and positioned so that the center of mass 128 of speaker 102 is positioned along a first axis 144 that extends from, and is perpendicular to, the first side 116. Accordingly, when the speaker 102 is supported on the first side 116 (i.e., the first side 116 is used as a base), the center of mass 128 is positioned above the first side 116. Therefore, the speaker 102 may stand on the first side 116, with the first side 116 serving as a base, in a stable manner.

As further illustrated in FIG. 3, to facilitate use of the second side 118 as a base without requiring a kickstand or other support-providing member(s), the controller 112 and the actuator 110 are arranged and positioned so that the center of mass 128 of the speaker 102 is positioned along the second axis 146 that extends from, and is perpendicular to, the second side 118. Accordingly, when the speaker 102 is supported on the second side 118, the center of mass 128 is positioned above the second side 118.

To provide yet another orientation from which the sounds may be projected, the third side 120 of the housing 104 is disposed at a third angle 138 relative to the front panel 114, with the third angle 138 differing from (e.g., being less than) the second angle 136. To facilitate use of the third side 120 as a base without requiring a kickstand or other support-providing member(s), the controller 112 and the actuator 110 are arranged and positioned so that the center of mass 128 of the speaker 102 is positioned along a third axis 148 that extends from, and is perpendicular to, the third side 120. Accordingly, when the speaker 102 is supported on the third side 120, the center of mass 128 is positioned above the third side 120.

To provide yet another orientation from which the sounds may be projected, the fourth side 122 of the housing 104 is disposed at an angle relative to the front panel 114, with the angle of the fourth side differing from (e.g., being less than) the third angle 138. To facilitate use of the fourth side 122 as a base side 130 without requiring a kickstand or other support-providing member(s), the controller 112 and the actuator 110 are arranged and positioned so that the center of mass 128 of the speaker 102 is positioned along an axis (not shown) that extends from, and is perpendicular to, the fourth side 122. Accordingly, when the speaker 102 is supported on the fourth side 122, the center of mass 128 is positioned above the fourth side 122.

To provide yet another orientation from which the sounds may be projected, the fifth side 124 of the housing 104 is disposed at an angle relative to the front panel 114, with the angle of the fifth side differing from the angles of the other sides. To facilitate use of the fifth side 124 as a base side 130 without requiring a kickstand or other support-providing member(s), the controller 112 and the actuator 110 are arranged and positioned so that the center of mass 128 of the speaker 102 is positioned along an axis (not shown) that extends from, and is perpendicular to, the fifth side 124. Accordingly, when the speaker 102 is supported on the fifth side 124, the center of mass 128 is positioned above the fifth side 124.

To provide yet another orientation from which the sounds may be projected, the sixth side 126 of the housing 104 is disposed at an angle relative to the front panel 114, with the angle of the sixth side differing from the angles of the other sides relative to the front panel 114. To facilitate use of the sixth side 126 as a base side 130 without requiring a kickstand or other support-providing member(s), the controller 112 and the actuator 110 are arranged and positioned so that the center of mass 128 of the speaker 102 is positioned along an axis (not shown) that extends from, and is perpendicular to, the sixth side 126. Accordingly, when the speaker 102 is supported on the sixth side 126, the center of mass 128 is positioned above the sixth side 126.

In an exemplary embodiment, each of the sides 116, 118, 120, 122, 124, 126 is oriented at a unique angle relative to the front panel 114 of the housing 104. For example, the first angle 134 may be between approximately 95 degrees and 85 degrees, while the angles at which each of the other sides are disposed relative to the front panel 114 cover a range of angles between approximately 85 degrees and zero degrees, providing a range of possible orientations for the front panel 114 of the speaker 102 from approximately vertical to approximately horizontal. It should be appreciated that any one of the sides 116, 118, 120, 122, 124, 126 may be disposed at any desirable angle, as made possible by the arrangement of components within the housing 104 and the resulting positioning of the center of mass 128. For example, the first angle 134 may be between approximately 85 degrees and 75 degrees. Alternatively, the first angle 134 may be between approximately 75 degrees and 65 degrees. Alternatively, the first angle 134 may be between approximately 65 degrees and 55 degrees. Alternatively, the first angle 134 may be between approximately 55 degrees and 45 degrees. Alternatively, the first angle 134 may be between approximately 45 degrees and 35 degrees.

Figure 5:
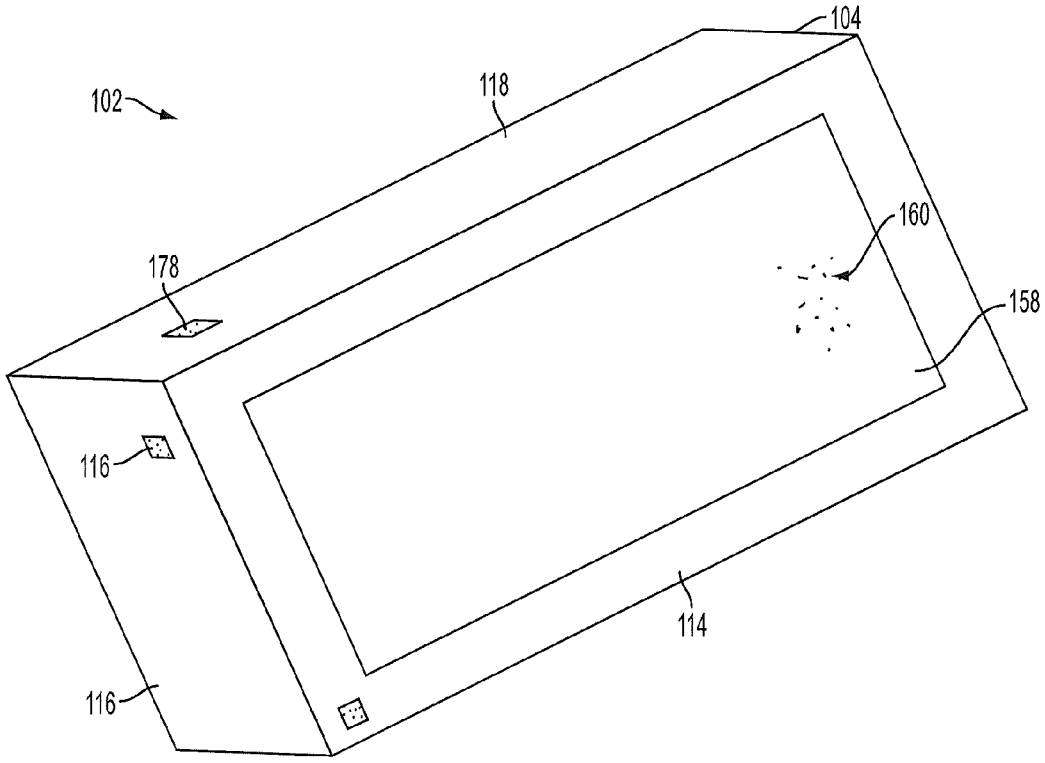
FIG. 5 is drawing showing a perspective view of an exemplary multiple-sided speaker.

As shown in FIG. 5, the front panel 114 includes a sound-emitting portion 158 configured to permit (i.e., capable of permitting) transmission of sound waves generated by the sound generating member 108 as it vibrates. In an exemplary embodiment, the sound-emitting portion 158 defines a plurality (e.g., hundreds) of perforations 160 that are laser drilled through the sound-emitting portion 158 of the front panel 114.

With further reference to FIG. 1, in an exemplary embodiment, a speaker 102 includes a receiver 162 for receiving information from an external source (not shown). The information may be configured to define (i.e., capable of defining) the sounds to be transmitted by the speaker 102 and/or logic to be used by the speaker 102 in processing other information. The information may be transmitted to the receiver 162 wirelessly (e.g., via Bluetooth) or via a wired connection as discussed below. The receiver 162 is in communication with the controller 112, which comprises a processor 164 in communication with a memory storage device 166. Information received by the receiver 162 may be stored in the memory storage device 166 and/or processed by the processor 164 as necessary to facilitate the controller 112 instructing the actuator 110 to cause the sound generating member 108 to vibrate, thereby generating sound waves.

The controller 112 may also be in communication with one or more sensor 168 configured for detecting (i.e., capable of detecting) an orientation of the speaker 102 and for sending a signal from the sensor 168 to the controller 112 indicative of the detected orientation. Based on the detected orientation (e.g., an angle of the front panel 114), the controller 112 may process the information received according to appropriate logic stored in a memory storage device 166 so as to produce sound waves configured according to the detected orientation of the speaker 102. Thus, the controller 112 may be configured for affecting (i.e., may be capable of affecting) the sound waves generated by the sound generating member 108 based at least in part on the orientation of the speaker 102.

Still further, the controller 112 may be configured for affecting (i.e., may be capable of affecting) the sound waves generated by the sound generating member 108 based at least in part on a preference defined by an user. Accordingly, the controller 112 may be configured to receive (i.e., may be capable of receiving) the preference from the user, to store the preference in a the memory storage device 166, and to retrieve the preference so as to apply it in determining how affect the sound waves generated by the sound generating member 108.

The speaker 102 may include a plurality of electrical connectors 176, 178, 180, each being disposed on the front panel 114 or on a respective side 116, 118, 120 of the speaker 102 and each being exposed for interfacing with a mating electrical connector (not shown) when its respective side 116, 118, 120 is not in use as a base 130 upon which the speaker 102 is being supported. Thus, in an exemplary embodiment, a first electrical connector 176 is disposed at first side 116, a second electrical connector 178 is disposed at second side 118, and a third electrical connector is disposed at third side 120.

In an exemplary embodiment, each electrical connector 176, 176, 180 is configured for mating (i.e., capable of mating) with a standard micro USB connector and may be configured for providing (i.e., may be capable of providing) transmission of information between the speaker 102 and another external component and/or for providing a supply of electrical power for driving the actuator 110 or for storage within a power storage device 170 of the speaker 102. Thus, each electrical connector 176, 178, 180 is configured for coupling (i.e., capable of coupling) an external source (not shown) of electrical power and/or information to the speaker 102.

In an exemplary embodiment, the receiver 162 is configured for receiving (i.e., capable of receiving) information from an external source via any one of the electrical connectors 176, 178, 180. To facilitate the incorporation of multiple electrical connectors 176, 178, 180 (and/or to prevent conflicts from occurring between signals or power received or sent between two or more of the electrical connectors 176, 178, 180), the controller 112 may be configured to control (i.e., capable of controlling) the processing of power and/or information received from the individual electrical connectors 176, 178, 180. For example, where a signal from the sensor 168 to the controller 112 indicates that a particular side 116, 118, 120 is in use as a base 130, the controller 112 may be configured to deactivate (i.e., capable of deactivating) that particular electrical connector 176, 178, 180. exist power and/or signal/information connections exist Further, where connections exist between external sources of power and/or information (i.e., signals) and two or more electrical connectors 176, 178, 180, the controller 112 may be configured to transmit (i.e., may be capable of transmitting) power and/or to process signals from only one of the electrical connectors 176, 178, 180 at a time. The controller 112 may determine which electrical connector 176, 178, 180 to use at a particular time based on a user-prescribed preference or based on logic. An indication of whether an electrical connector 176, 178, 180 is active or inactive may be provided, such as via an external display or an illuminated LED (e.g., a green LED indicating an active connector/connection and a red LED indicating an inactive connector/connection).

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted, or not implemented.

Also, techniques, systems, subsystems and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A speaker comprising:

a housing that defines an internal cavity and includes a front panel, a first side, a second side, and a third side;

a plurality of components disposed within the internal cavity, the plurality of components comprising a controller, an actuator, and a sound generating member, the controller being in communication with the actuator, and the actuator being configured for causing the sound generating member to vibrate, and thereby generate sound waves, as instructed by the controller; and a plurality of electrical connectors, each of said plurality of electrical connectors being configured for coupling an external source of power or signals to the controller;

the front panel being configured to transmit the sound waves;

wherein the first side is disposed at a first angle relative to the front panel, the second side is disposed at a second angle relative to the front panel, and the third side is disposed at a third angle relative to the front panel, the second angle being less than the first angle, and the third angle being less than the second angle;

the speaker having a center of mass that is positioned along an axis that extends from, and is perpendicular to, the first side;

the center of mass being positioned along an axis that extends from, and is perpendicular to, the second side;

the center of mass being positioned along an axis that extends from, and is perpendicular to, the third side;

wherein the controller is configured to determine which of said plurality of electrical connectors to activate based on an orientation of the speaker.

2. A speaker as described in claim 1, wherein the first electrical connector includes an indicator for indicating whether the first electrical connector is active or inactive.

3. A speaker as described in claim 2, wherein the second electrical connector includes an indicator for indicating whether the second electrical connector is active or inactive.

* * * * *